US005653876A

United States Patent [19]

Funke

[11] Patent Number: 5,653,876

[45] Date of Patent: Aug. 5, 1997

[54] HIGH PRESSURE PUMP FOR FINE LIQUID METERING

[76] Inventor: Herbert Funke, Läutenring 29, D-85235 Pfaffenhofen/Glonn, Germany

[21] Appl. No.: 428,164

[22] PCT Filed: Oct. 28, 1993

[86] PCT No.: PCT/DE93/01031

§ 371 Date: Jun. 11, 1995

§ 102(e) Date: Jun. 11, 1995

[87] PCT Pub. No.: WO94/10445

PCT Pub. Date: May 11, 1994

[30] Foreign Application Priority Data

| | | | |
|---|---|---|---|
| Oct. 28, 1992 | [DE] | Germany | 42 36 445.0 |
| Dec. 23, 1992 | [DE] | Germany | 42 43 911.6 |
| Mar. 3, 1993 | [DE] | Germany | 43 08 467.2 |

[51] Int. Cl.[6] ..... B01D 15/08

[52] U.S. Cl. ..... 210/198.2; 210/101; 210/656; 417/20; 417/44.2; 417/254; 417/503; 417/532

[58] Field of Search ..... 417/20, 44.2, 254, 417/503, 532; 210/656, 101, 198.2; 422/70

[56] References Cited

U.S. PATENT DOCUMENTS

| | | | |
|---|---|---|---|
| 2,550,392 | 4/1951 | Venning | 103/211 |
| 3,792,939 | 2/1974 | Zalis | 417/539 |
| 3,917,531 | 11/1975 | Magnussen | 417/20 |
| 4,359,312 | 11/1982 | Funke et al. | 417/18 |
| 4,456,440 | 6/1984 | Korner | 417/540 |
| 4,600,365 | 7/1986 | Riggenmann | 417/246 |
| 4,775,481 | 10/1988 | Allington | 417/44.2 |
| 4,808,092 | 2/1989 | Funke | 417/454 |
| 4,883,409 | 11/1989 | Strohmeier | 417/44.2 |
| 4,915,591 | 4/1990 | Funke | 417/18 |
| 5,089,124 | 2/1992 | Mahar | 417/20 |
| 5,158,675 | 10/1992 | Allington | 417/503 |
| 5,466,128 | 11/1995 | Brown | 417/254 |

FOREIGN PATENT DOCUMENTS

| | | | |
|---|---|---|---|
| 0228628 | 7/1987 | European Pat. Off. | 417/18 |
| 697009 | 10/1940 | Germany | 417/20 |
| 911805 | 5/1954 | Germany | 417/20 |
| 2737062 | 3/1979 | Germany | 417/18 |
| 2940606 | 10/1979 | Germany | 417/20 |
| 3619821 | 12/1986 | Germany | 417/20 |
| 406854 | 8/1966 | Switzerland | 417/20 |

*Primary Examiner*—Ernest G. Therkorn

*Attorney, Agent, or Firm*—Eckert Seamans Cherin & Mellott

[57] ABSTRACT

In order to reduce the overall size of serial pump arrangements, several block-disk-like building elements are used. These building elements are made of a non-metallic material and lie against each other with their control surfaces in a sandwich like stack. Two of the block-disk-like building elements have displacement chambers oriented transversely to the axis of the stack, in each of which is guided a push piston. Inflow and outflow bores in which the high pressure mass flow, for example a chemical buffer, is created, extend parallel to the stack axis. Both building elements form two serially arranged pumping units of the serial pump arrangement and ensure a constant and continuous mass flow. Check valves are provided at the suction and delivery sides of both pumping units. Besides saving space, this arrangement ensures a highly constant and continuous mass flow, as the throughflow paths are as short as possible. The building elements may be made of metal-free but highly stable materials, including sapphire. Because of their shortness a minimal dead volume is obtained, and because of the metal-free materials there is practically no elasticity.

40 Claims, 6 Drawing Sheets

HIGH PRESSURE PUMP FOR FINE LIQUID METERING

The technical scope of the invention(s) is the fine metering of liquids, also at high, pressure (especially the HPLC analysis technique). In this field pumps are needed which deliver free from or with a minimum of flow pulsation and employ two (principally) different design concepts. These are represented on the one side—as most frequent representative—by a reciprocating or high pressure pump set up with two cylinders or pumping units respectively, working together in parallel. On the other hand by a serial arrangement of the pumping units.

In fact, with the pumping units arranged in parallel, usually a low pulsation is achievable—i.e. a very uniform and constant mass flow. At the same time such an arrangement of the pumping units requires larger space. Both cylinders are arranged side by side, and pertinent liquid channels at the high and low pressure side connect the parallel pumping units with alternately working pistons. Examples of the parallel high pressure pump set-up are described in source DE 27 37 062 (Zumtobel) and U.S. Pat. No. 3,917,531 (Magnussen). Besides the parallel high pressure set-up there are also the—mentioned—serial-type high pressure pumps with both pumping units serially arranged in flow direction. Principally there to, both pumping units are configured side by side—as with the mentioned parallel arrangement—however, the channels are embodied in flow direction in such way, that the liquid which is delivered under pressure from the first displacement chamber, is discharged via the second chamber (acting as storage vessel). Such an arrangement is object of source DE 32 03 722 C2 (Gynkotek) with regard to a special configuration of the pistons being linearly driven in a to each other co-ordinated mode with the aim of a reduction of flow pulsation in conjunction with a serial-type pump set-up. Concerning the technical background of the need for a continuous mass flow, here is expressly referred to column 6 in the mentioned documentation (patent). Aim and purpose of said pump set-up is to increase the accuracy of substance determination behind the separation column by minimizing residual pulsation. With the given application no interference signal must occur due to the (low) specific compressibility of the liquid being pumped (eluent) by the high pressure pump set-up.

This is also a task of the invention(s), i.e., to further increase the constancy of the mass flow. This, however, not by a complicated mutual tuning of the reciprocating motions of the pistons (compare latest cited source) but by means of a principal redesign of the pump set-up. This especially, through pumping efficiency by means of minimizing the detrimental dead volume in the liquid displacement system.

This task is solved by a serial-type dual piston pump set-up in a (sub)miniaturized design for constant and continuous mass flow with two pumping units arranged serially—with reference to the flow direction—to each other, each of them having a liquid displacement piston and with two check valves at the feeding side and at the high pressure side, in which a series block/disk-shaped constructional elements with their control surfaces adjacently positioned to each other to form a stack/sandwich-type build-up, with two of the constructional elements having each a liquid displacement chamber, perpendicularly orientated to the axis of the stack/sandwich-type build-up, receiving the respective pistons, and being fitted with liquid ducts for feeding and discharge in a parallel direction of this axis (claim 1).

The same task finds its—independent-solution in an assembly concept for the mentioned high pressure pump set-up in which in the stack/sandwich build-up space a variety of functional units are arranged; the functional units—which perform different functions, such as directing the feeding flow, forming a gradient at the low pressure side, deviating the displacement flow and measuring the working pressure on the discharge side, liquid displacement by the main piston, liquid displacement by the storage piston—are combined with each other, directly sealed to each other by virtue of congruent shape within the stack/sandwich-type build-up space; the functional units in the stack/sandwich build-up space are radially fixed and axially pre-loaded by means of a clamping device (claim 14).

Also the displacement assembly for the mentioned serial-type high pressure pump set-up solves the task put ahead: A liquid displacement unit for a high pressure pump set-up, working according to the serial liquid displacement principle to which only one kind of displacement chamber is associated and one valve directly at the inlet channel to the displacement chamber—mainly perpendicular to the longitudinal axis to said chamber (claim 20).

Besides the mentioned (one) task, from the implementation of the invention(s) results the surprising beneficial effect that the serial-type pump set-up requires only an extremely small constructional space. This beneficial effect inherently originates from the invention's perception, to divide the serial-type pump set-up into—several—functional sub-units.

Consequently, these functional sub-units can be fitted together in a sandwich-type build-up (claim 4) within smallest constructional space. The functional sub-units are block/disc-shaped constructional elements. They may be manufactured from non-metallic materials. They are fitted together to the invention's stack-type build-up resulting already in the serial-type pump set-up (claim 14). The liquid displacement chambers are orientated perpendicularly to the axis of the stack of the block/disc-shaped constructional elements (claim 1); in which the pistons are alternatingly reciprocating. Supplementary to the stack-type build-up of the block/disc-shaped constructional elements, the liquid displacement chambers are connected with each other by feeding (inlet) and discharge (outlet) bores, which in turn are orientated parallel to the stack axis. At the liquid feeding and discharge sides, check valves are arranged (claim 1,3) which represent, with their peripheral components, elements for the mechanical alignment.

The stack/sandwich build-up is beneficial for the arrangement of the check valves since the block/disc-shaped constructional elements are positioned adjacent to each other. Consequently, no additional liquid connecting lines are needed between the pumping units. Thereby it is possible to integrate the inlet and the outlet check valves directly in the block/disc-shaped constructional element which forms such a pumping or liquid displacement unit. Thereby always only one check valve has to be fitted to each block/disc-shaped constructional element (claim 2,3). This promotes an additional beneficial effect of the invention, i.e. the compact design and the minimization of detrimental dead volume in the liquid displacement system respectively. The connecting check valves in inlet and outlet configuration can have an identical design for both block/disc-shaped constructional elements. Specifically, the elimination of all intermediary liquid connections is an advantage for the serial-type pump with its pump units (displacement chambers) adjacently joined together in flow direction. Thus the connecting line length is reduced to nearly zero and, by virtue of direct integration between the pumping units, and the other block/disc-shaped constructional elements having special function, the check valves can be actuated with higher precision (claim 3) leading to reduced residual pulsation.

Reducing of flow pulsation—especially at very low flow rates—is furthermore enhanced by means of check valve design (claim 3); in special configuration check valve ball guide and ball stopper profile can be machined directly into the displacement chamber.

An especially favorable design configuration of the check valves arranged between the block/disc shaped constructional elements is designing the check valve in the form of cartridges (claim 7). Such cartridges comprise one or two check valves. The check valve cartridges are mounted in such way between two adjacently joined block/disc-shaped constructional elements that half of their length inserts into each element. Thus not only the check valve incorporating liquid connection is provided between the functional discs, but also mutual alignment of the constructional elements along their perpendicular axis.

Check valve or dummy cartridges can be inserted between all block/disc-shaped constructional elements comprised in the stack; thus between the storage head and the pumping head, between the inlet rotary valve and the pumping head, or between the storage head and the pressure sensor/bleeder valve unit. Depending upon he intended function the check valve cartridge may comprise one or two check valves. Furthermore, it is possible to employ a dummy cartridge which simply features a bore as liquid duct. Thus, e.g. the outlet side of the storage head can be fitted with such a dummy cartridge in order to provide a liquid connection to the pressure sensor/bleeder valve module, which represents the forth element of a serial-type pump set-up (Inlet rotary valve, delivery head, storage head and outlet module).

Furthermore, obviously the possibility for a faster assembly is given (claim 14) for each of the block/disc-shaped constructional elements, each one bearing a specific function. They must only be arranged in the respective stack for forming a serial-type pump set-up. Inherently, maintenance and replacement of damaged functional units is facilitated. The feeding and discharge bores, or inlet and outlet liquid ducts in the block/disc constructional elements, which are mentioned in claims 1 to 7 are aligned with each other. Their location in the center of the parts facilitates manufacturing (claim 8). As a result shortest possible connections are achieved between the block/disc displacement chambers, leading to minimum dead volume.

A summarized description of the mentioned functional units is given as follows:

(a) One functional unit can be the "main head"; it represents the main pumping unit (claim 1)

(b) An additional functional unit can be the "storage head", representing the storage pumping unit which is positioned behind the main head. Also the outlet check valve of the main head can be integrated within this functional unit, laying basis for necessarily short liquid connection between main head and storage head. Thus detrimental dead volume is minimized in the displacement system which entails residual pulsation of the delivery flow and to loss of pumping efficiency due to the specific compressibility of the liquid medium being pumped (claim 1).

(c) One functional unit can bear switching valve function at the feeding side; this functional unit precedes the main head and enables the selection of different pumping media (claim 5) and the introduction of solvent gradients, generated at the low pressure side (controlled proportionating of different liquids during a defined period of time. Compare claim 4).

(d) One functional unit can embody pressure monitoring and additionally, bleeder valve function; this functional unit is arranged behind the storage head. This units represents in the basic implementation of the design concept the high pressure terminal of the complete serial-type pump set-up. It allows to monitor pressure in the system by deviating the delivery flow onto a built-in sensor. (claim 6).

For the control of exerted hydraulic forces, and the same time, in order to achieve internal and external sealing in the complete displacement system, mechanical restraining and pre-loading of the various sub-elements is required; this can be effected by insertion of respective peripheral sealing elements and by pre-loading the functional units in the stack/sandwich build-up between the arms of a yoke-type body, or within a common receiving bore of a housing block.

In case of choosing a cylindrical shape for the block/disc constructional elements and consequently, embodying a cylindrical sandwich-type serial-type high pressure pump, the different block/disc-shaped functional elements can feature a flat section at the mantle surface, at which a piston guide bushing is to be placed, —intermediary sealed when being mounted, with the displacement piston reciprocating in the guide elements in transverse direction to the stack axis; said guide can be composed of a metallic bushing (stainless steel or titanium) and two guide rings from ceramic material fitted apart into the bushing (claim 10). Between the guide rings a rinsing chamber is formed, which discontinuously or continuously renewed volume of rinsing liquid (water) prevents the formation of salt crystals when pumping buffer solutions which deploy an abrasive effect onto the piston seals. Also, externally to each of he guide rings a peripheral sealing element can be arranged, sealing the rinsing liquid reservoir. The ceramic guide rings can be shrink-fitted into the bushing with their guide bore aligned to each other. The reservoir chamber to be supplied with rinsing liquid via capillary tubing ports.

The basically changed build-up of the serial-type high pressure pump, with the two pump units—main head and storage head—is furthermore manifested by the assembly procedure for such a pump set-up (claim 14). Quite obviously, the functional units are arranged to each other in a stacking space, axially freely movable (in the first instance), radially however, fixedly guided. Axial fixation or pre-loading is subsequently performed by means of a clamping device; thus providing a completely functioning serial pump system, based on the combined functional units. From this appears the possibility for simple (dis)assembly, as well as the potential for miniaturized construction. Essentially, the functional units can have a cylindrical form (claim 15); thus manufacturing of the components and joining them together is facilitated. In special configuration, the outlet check valve of the main head can be directly integrated into this unit or alternatively, partly into the storage head arranged behind (claim 16). The valves can be based on check valves (claim 17 to 19); with the sandwich build-up the valve balls can be inserted at the appropriate position. By the direct integration of the check valves special holding and mounting devices are made obsolete. Alone the valve ball is paired with a seat, which is inserted into the valve chamber after having placed the ball into the (integrated) ball stopper/ball guide bore (claim 17). Additionally, the seat can be backed by a—sealing—flange ring (claim 18). Said sealing ring facilitates the (radial) alignment of the stack.

Special emphasis has to be made of the multi-bore ball guide bore (claim 17), allowing a direct machining into the block disc, eliminating the need for separate ball guide and ball stopper elements. As a result, the check valve comprises less peripheral components.

A closely related invention suggests for both the main head and the storage head the use of a liquid displacement chamber of identical design (claim 20). This aims for allowing a rational manufacturing of the serial-type high pressure pump set-up (claim 1). Said functional block features a liquid displacement bore with the piston seal, and in perpendicular direction, the inlet bore and outlet bore, with check valve at the inlet side each. The described functional block can be modified for the embodiment of additional functions.

In order to achieve a constant delivery special attention has to be also paid to the piston drive. In order not to efface the surprising beneficial effect that the serial-type high pressure pump needs any longer only for a minimum of constructional space, the drive system must ensure constant delivery and minimum dimensions as well. Otherwise the liquid displacement assembly of the serial pump which can be specially small built would be burdened by an oversized drive unit. Therefore, a Z-shaped drive piston is suggested, which essential features are summarized in claim 21. Thereby the Z-drive piston features a first arm and a second arm which both are mainly orientated in parallel to each other. The first arm is indirectly in contact with a rotating cam. This force transfer allows the Z-drive piston—being guided by means of two guide rods mounted apart from each other—a reciprocating motion. Since two guide bearings are foreseen, which are sliding on the guide rods mounted apart, a highly precise parallel displacement of the Z-lever (drive piston) is achieved. Additional anti-canting and anti-rotation devices are made obsolete. The Z-drive piston generates besides compactness an enhancement in the flow constancy by avoiding system elasticity. It finally also simplifies the assembly and the adjustment of the drive.

Both mentioned arms can be connected by means of an intermediary arm (claim 22). This does not change the rigidly mechanical connecting of arms, because the intermediary arm connects both arms mechanically rigid; this, being mainly in perpendicular alignment with the first mentioned arms.

The cam by which means the drive force is exerted onto the Z-drive piston can (indirectly) be effective onto the first arm via a rotating roller; a compression or a tension spring is employed to generate the filling stroke by inducing a counter load at the first arm, ensuring that the mechanical contact between the roller and the cam is never lost (claim 23). When using a tension spring, this spring is acting on the side of the first arm onto which the roller is not being effective (claim 24).

Arranging both the stationary guide rods on both sides of the point of force introduction for the lower arm, a symmetrical configuration is yielded, which allows a specially precise reciprocating motion. Canting and rotating motions are eliminated if the guiding rods travels through the intermediary arm and when this arm is fitted with two bearing elements which allows sliding on the guide rod (claim 28).

Both the displacement pistons in the main head and the storage head for the serial-type pump set-up are reciprocatingly actuated by drive pistons of the described design. The displacement pistons are sideload-free—with reference to the piston seals —actuated within a bushing made from stainless steel or titanium, which features two ceramic rings, fitted apart therein, as actual guiding elements (claim 11).

A special restraining device is needed in order to press the precisely aligned piston guide bushings against the block/disc-shaped constructional elements which are configured as main head and storage head by a force which excludes resilience under the hydraulic load being effective onto the piston seal during pump operation. Such a restraining device can be e.g. a screw connection by which means the piston guide bushing is pressed against the flat section at the outlet of the displacement chamber bore of the pertinent [respective] block/disc-shaped constructional elements.

For this purpose a guiding is needed which aligns the guide bushing sideload-flee in reference to the piston seal. As a solution which is also simple from the manufacturing standpoint of view, a restraining device is here suggested, which features an elongated trunk which is simply to be guided at the housing body of the serial-type pump and a—transversely to the trunk axis—protruding fork section as tension hook. (claim 30).

At the end of the elongated trunk a loading device is foreseen, which can be a screw which engages in a threaded bore within the trunk and is counter-held in the housing body of the serial-type pump set-up. (claim 33). This loading device makes the L-shaped holding hook which is formed by the fork arms and the trunk, slidable in parallel to the displacement piston (claim 32). A very precise parallel displacement of the L-shaped holding hook is achieved by means of two supporting buttresses at the trunk being offset to each other (claim 30); thereby it can be foreseen that the buttresses are offset in reference to both the longitudinal and the transversal axis of the trunk (claim 34).

By configuring one of the buttresses as fork section which protrudes from the trunk body, a groove is formed (claim 31) through which the displacement piston travels freely. In this way a maximum of accessibility is achieved. Even after assembly of the block discs and the piston guide bushings, the displacement pistons can be shifted into the fork section of L-shaped holding hooks, and the piston guide bushings can be frontally pressed against their block discs by means of the restraining device, or the restraining force can be adjusted respectively. Applying the same procedure, in inverse sequence, the piston guide bushings can be removed from their block/disc-shaped displacement chambers in the sandwich stack; thereby, after having sufficiently loosened the L-shaped holding hook, the piston is completely released by withdrawing it from the fork-buttress together with the guide bushing, thus removing it from the block/disc-shaped constructional element. From the good accessibility results a construction which is especially easy to maintain. The same time the holding hook is easy to adjust, since it can be tightened or loosened via the loading device being always accessible (claim 35).

One of the mentioned supporting buttresses can be configured as cross-pin which is located in the transition area of the trunk and the fork section and protrudes from both sides of the elongated trunk body (claim 36). With the at both sides protruding cross-pin—which could be also divided—the holding hook rests then upon the lateral shoulders of a guiding slot in the mounting flange of the housing body in which the trunk body of the holding hook is fitted with sufficient play.

The L-shaped holding hook is especially compatible with the Z-drive (claim 30, claim 21) whereby the L-shaped hook is positioned between the Z-drive piston and the functional block discs of the serial-type pump set-up (claim 1). In their combination, both the Z-drive piston and the L-shaped holding hook promote a miniaturized build-up. Additionally, the restraining force by which the piston guide bushing is pressed against the functional block disc is strong enough to securely avoid any elastic deformation under the influence of the considerable hydraulic forces exerted onto the piston seal during the displacement stroke (Avoidance of system elasticity to maintain maximum pumping efficiency).

In order to optimally introduce the loading force exerted by the L-shaped holding hook onto the piston guide bushing, a washer-type ring is foreseen, which also serves as backing ring for the secondary piston seal, providing dynamic sealing of the rinsing liquid reservoir in the guide bushing.

The sandwich-construction concept described above in detail for a serial-type pump set-up can be extended by supplementary functional sub-units, and thus lay basis for various compact analysis systems which are based on precision liquid metering for substance separation, or for a chemical reaction for substance determination (claim 37).

Based on the concept of arranging the functional sub-units of the displacement assembly for a serial-type pump set-up it is suggested, i.e. to incorporate a sample injection, separation column and detector cell block disc, in order to establish the complete wet part of a comfortably portable miniaturized HPLC analysis system.

It is foreseen that the supplementary functional constructional sub-units are fitted with each other also without connecting tubings for the control of the liquid flow (eluent) (in order to avoid a detrimental effect on the achieved substance separation at certain locations, i.e. the transition from the separation column to the detector cell) (claim 38). In order to obtain congruent constructional form also for the (HPLC) separation column, which has usually the form of a straight tube, it is suggested to configure it as a bundle of columns with several packings in one basic body, with terminal late elements on each end, providing cross-and pass-through connections via small zig-zag shaped liquid channels, or alternatively, as plane separation sub-unit, containing a column packing in spiral or meander-shape form.

Between the serial pumping set-up and the supplementary separation column sandwich sub-unit, a sample injection sandwich sub-unit is integrated, in order to allow the introduction of the sample. Directly to the outlet of the separation column sub-unit, a detector cell (separated from the detector) is attached for the substance determination. Eventually the connection between measuring cell and detector electronics is to be established by use of fibre optics.

With regard to the sandwich design of the serial-type pump set-up reference is made to claims 1 to 13 (claim 40). This set-up generates the eluent flow which is discharged via the bleeder valve/pressure sensor functional unit, which is determined with regard to its chemical composition through the supply via the inlet functional unit (connection to different reservoirs via multi-port slider valve, claim 39).

In a special case the inlet module can be a low pressure side gradient former which controls the mixing ratio of parallely fed-in liquids by the use of a timed program.

The pumping set-up according to claim 12 allows with a higher than ambient pressure the metering of precisely defined liquid volumes. At the same time the precise metering is reproducible. Embodiments of the invention are described in greater detail.

BRIEF DESCRIPTION OF THE DRAWINGS

FIG. 4 shows the backside of the displacement piston 16,17 in top view (top view of displacement axis 28, 29) and FIG. 4 the cross-section through a z-drive piston 51, the holding hook 70, 71 and the liquid displacement chamber 4,5.

DESCRIPTION OF THE PREFERRED EMBODIMENTS

Figure 1:
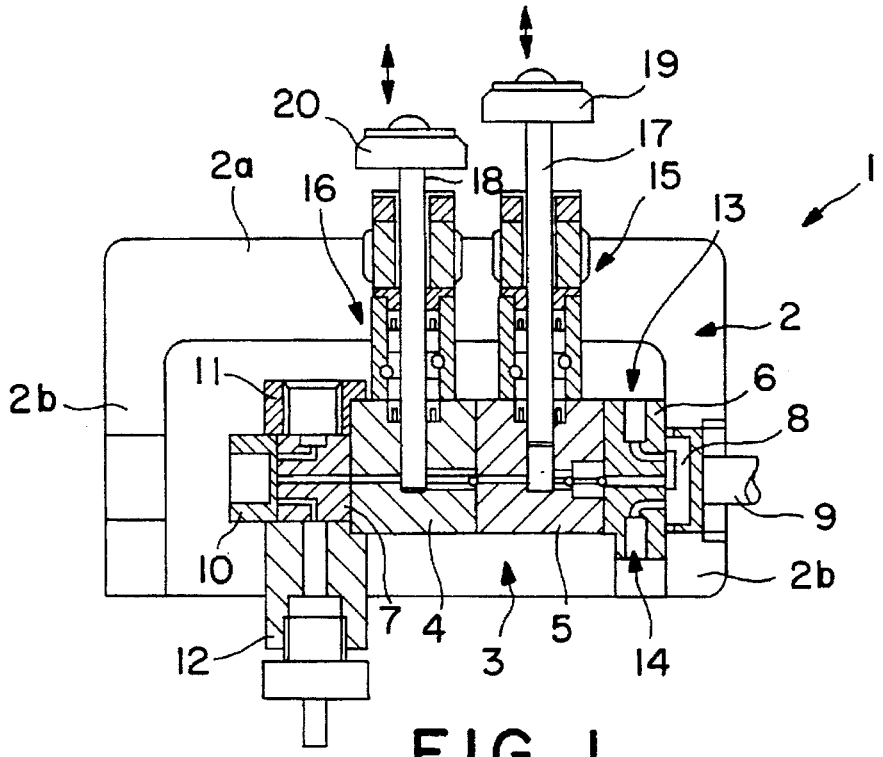
FIG. 1 showing a serial-type pump set-up in sandwich design in which the functional sub-units 4,5,6,7 are arranged to each other in a stacking space, or are compiled to a stack 3, which is held together between two arms 2*a*, 2*b* of a U-shaped profile 2 in axial direction.
Figure 2:
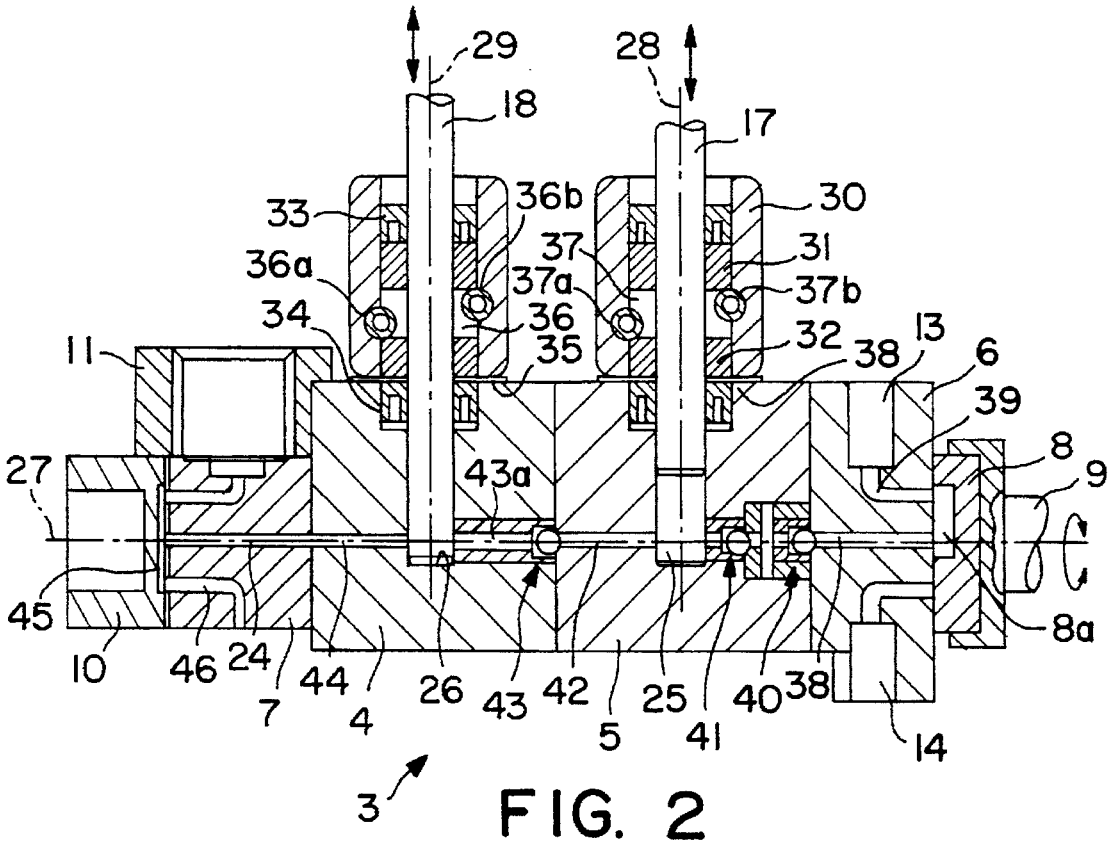
FIG. 2 showing a magnified cross-section of the serial-type pump set-up which is here configured by four functional units, with two of them, representing the liquid displacement sub-units.
Figure 7:
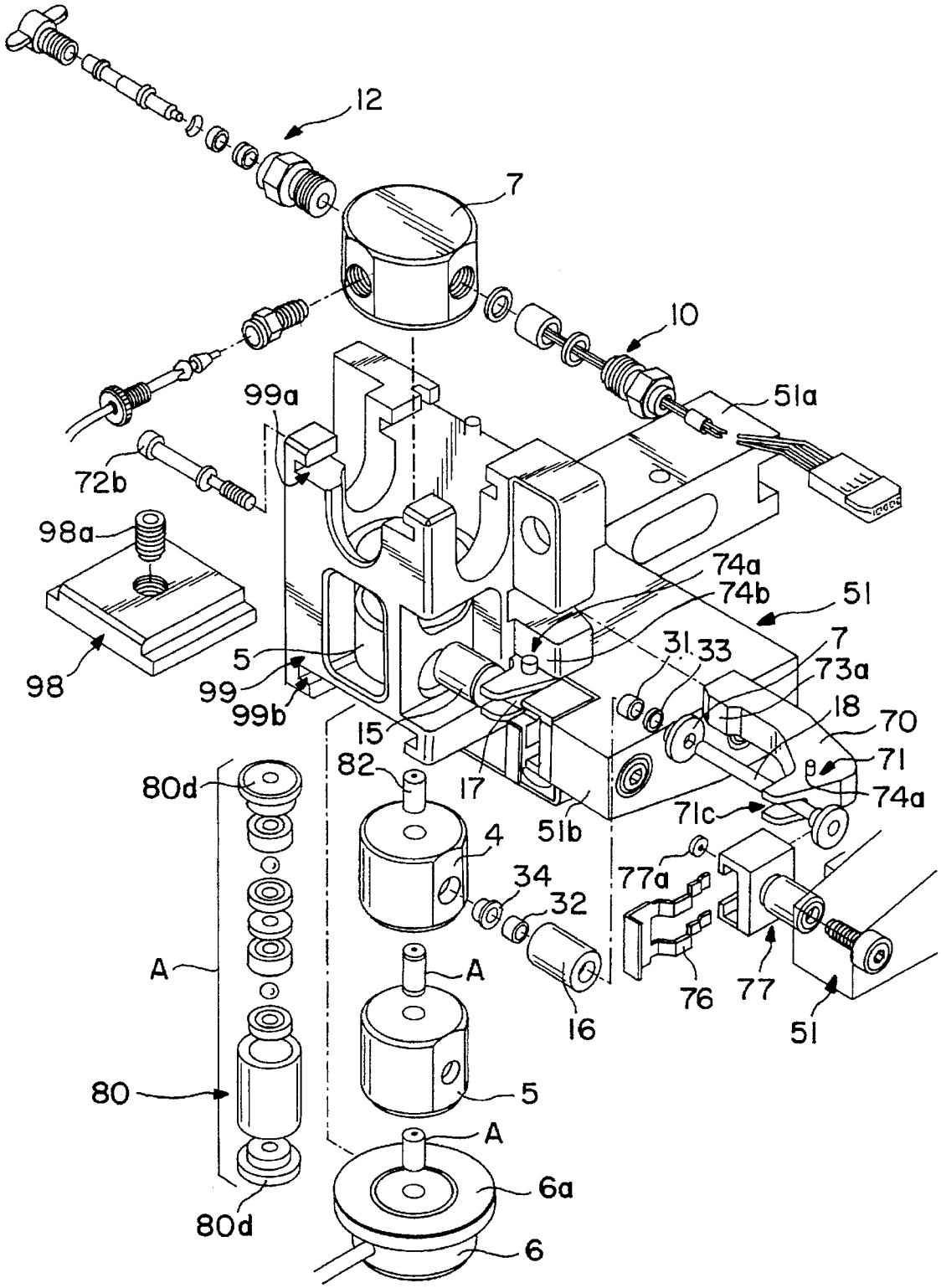
FIG. 7 illustrates with an exploded view several of the above-described structural components which form the serial pump unit. The letter A here represents one of the valve cartridges 80 with its details enlarged. One of the conveyor pistons 17 is installed; the other conveyor piston 18 is shown in detail with the L-shaped clamping hooks 70, 71 in the unassembled state.

The function carriers 4 and 5 are illustrated in FIGS. 1 and 2 in cut-away view and in FIG. 7 in an exploded view. The displacement chamber boring in the function carriers 4, 5 expands according to FIG. 7 at the other end to form a groove to receive the piston seal 34 (e.g. jacket of PTFE with stainless steel springs to hold the sealing lip under tension) whose spine also assures the static sealing of the rinsing fluid present in the piston guide sleeve 16. For dynamic (unpressurized) sealing at the lower end of the guide sleeve 16 a secondary piston seal 33 is used which is supported by the shim ring 7. The end face of this ring which remains free forms the support for the clamping hook 71. In order for tensile forces generated by means of the fork shield 71*c* on this hook by tightening the clamping screw to be initiated free of side loads exactly parallel to the axis of the (ceramic) plunger 18, the contact surface of the shim ring 7 is kept convexly bulged. In order to assure an accurate alignment of the plunger 18 in the displacement boring relative to the corresponding piston seal 34, the paired surfaces of the displacement chamber 4, 5 and piston guide sleeve 16, 15 are precisely specified with respect to their maximum permissible deviation from flatness relative to the axis of the piston boring. This is also applicable with respect to the concentricity of the two ceramic rings 31, 32 fixed in the piston guide sleeve 16, 15 as the actual guiding elements. These guiding rings are spaced apart in order to achieve the desired two-point support. By spacing the rings, in the piston guide sleeve 16, 15 a chamber is formed which permits through connections a back flushing of the piston seal 34 in the displacement chamber 4, 5 (prevention of the formation of salt crystals during the conveying of buffer solutions which would promote wear of the seals).

In order to assure nondeviating guidance (axis of motion parallel to the stroke axis of the plunger) of the clamping hook 71 even under a load, the latter is guided in the horizontal direction in a close-fitting groove of the housing 99 of the displacement unit and in the vertical direction is supported without tipping via a supporting bulge 73*a* and a cross pin 74*a* overhanging it on both sides at the maximum distance. As a result the supporting bulge 73*a* comes to rest on the base surface of the above-mentioned guide groove and the cross pin on the front surface 74*b* which is precisely fitted dimensionally to the reference axis, of the corresponding attachment flange (right) on the housing 99 of the displacement unit. The side face of the opposite attachment flange (left) is the counterbearing for the screw 72*b* which tightens the clamping hook, so that the latter engages a threaded boring on its end face on the side of the supporting bulge. The recess in the fork fitting 71*c* of the clamping hook 71*c* which acts on the piston guide sleeve 15, 17 is dimensioned such that the plunger 18 runs in it without touching.

The stroke movement of the plunger 18 activates a Z-shaped drive piston 51 (supported at three points) which carries on its front leg 51*b* a coupling piece 77 provided with two L-shaped holding straps and a central recess for the plunger flange, said coupling piece displaying a ceramic disk 77*a* as a contact element for the convexly bulging plunger end. A plug spring 76 whose centrally bent legs after engaging the coupling piece 77 press against the flange ring on the piston creates a coupling between the drive piston 51 and the plunger 18 that is free-floating in the radial direction but totally inflexible in the axial direction.

Each of the displacement chambers 4, 5 is matched on the inlet side with a valve cartridge 80 (identical and aligned in the same direction). The valve cartridge on the main head 5 (inlet valve) engages with half of its length the inlet module 6 (with a two-way rotary valve or low pressure gradient former) and with the other half engages the receiving boring on the head itself. The second valve cartridge (outlet valve) forms, according to the overhanging type of installation described above, the connecting link between the main head 5 and the subordinate storage head 4 (serial high-pressure arrangement).

The receiving borings for the valve cartridges open through fine piercing borings into the displacement chamber borings (T profile penetration). In order to be able to use an identical configuration for the main head 5 and the storage head 4, a dummy cartridge 82 with a simple central boring installed in the semi-overhanging mode, creates the hydraulic connection between the storage head 4 and the outlet module 7 which as a result has a double function when it is equipped with a pressure sensor 10 to monitor the conveying pressure and a spindle valve 12 which upon manual activation makes it possible for the displacement system to be vented. The peripheral seal on all transition sites in the entire liquid path through the displacement system is accomplished with the aid of flange sealing rings made of chemically inert plastic at both end faces of the valve cartridges 80. The mechanical tension necessary for sealing over the entire sandwich arrangement is supplied by a tension screw 98*a* in the lid element 98 whose flange bars snap into grooves in the housing body 99*a*. An inlet module 6 fixed via amounting flange also in housing grooves 99*b* acts as the support.

Figure 3:
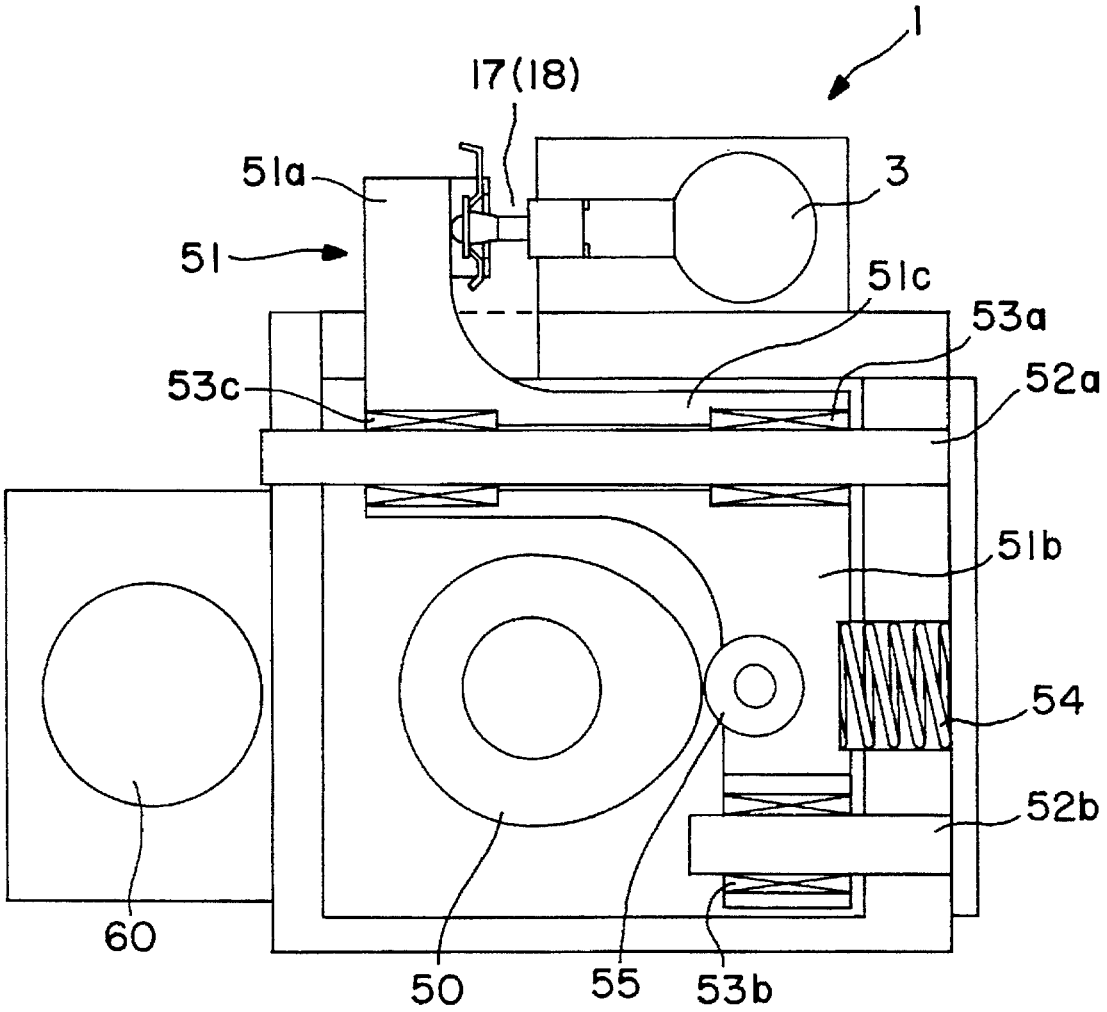
FIG. 3 showing the cross-section through a Z-shaped drive piston for the serial-type pump set-up according to FIG. 1 and 2 which is especially compact and effectuates a kinematically highly precise reciprocating motion of the displacement piston.

The Z drive piston 51 in FIG. 3 in combination with the cam shaft 50 connected via a transmission to the motor 60 supports the advantages of the displacement unit of the serial pump arrangement 1 in the stacked construction; the drive mechanism 50, 51, 60 is coupled with the displacement unit 1, 3 on the plunger 17, 18; in this case the axis 27 of the stack of the pump arrangement 1 extends out of the plane of the paper, while the stroke movement of the Z drive piston 51—which displays legs 51*a*, 51*b*, 51*c* offset in each case by 90°—of the drive mechanism takes place in the plane of the paper. The stroke movement of the Z drive piston takes place along two guide rods or rails 52*a*, 52*b*. On them axial bearings run 53*a*, 53*b*, 53*c*, the one bearing 53*b* being arranged in the outer region (outside) of the one leg 51*b* (cross leg on the cam disk side) and mounted on one of the two guide rods 52*a*, 52*b*. The cross leg 51*a* parallel (on the pump side) to the cross leg 51*b* on the cam disk side represents with its free end the contact with the plunger. At the transition site a plug spring produces a freely floating support for the plunger, i.e. the independent radial alignment during assembly of the piston parallel to the axis of the seal or the piston guide sleeve. The freely floating support assures a joining of the plunger to the Z drive piston without side loads and at the same time facilitates the flanging of the displacement unit 1 on the drive block. The design configuration described is the same for the main piston and the storage piston.

Between the two guide rods 52*a*, 52*b*—advantageously in the center—opposite forces act on the cross leg 51*b* on the cam disk side; in one direction the driving force is transmitted via a cam disk 50 and a roll 55 to the cross leg 51 on the cam disk side, in the other direction the force of a compression spring 54 is acting which assures by overcoming the frictional force of the piston seal that the frictional connection between the roll 55 to the Z drive lever 51 and the drive cam disk 50 is preserved during the entire stroke movement.

The (different) cam disk profiles for the pistons of the two displacement function units 4,5 operating in series with one another are designed for minimal residual pulsation of the conveyed stream due to the compressibility of the conveyed liquid under certain operating conditions. An electric motor 60 via a—not shown—gear box drives the cam disk (shaft). The rate of conveying is varied by regulating its rpm.

The design of the restoring spring 54 assigned to the cross leg 51*a* of the Z drive piston 51 and the choice of a plug spring 76 for the coupling of the drive piston and the plunger to the opposite leg 51*a* opens up the possibility of making the entire system extremely small but at the same time mechanically sufficiently stiff. At the same time, assembly is facilitated.

The three-point support 53*a*, 53*b*, 53*c* of the Z drive piston 51 described above on the two guide rods 52*a*, 52*b* assures the most accurate stroke movement. They also make additional devices for protection against twisting (tilting) unnecessary.

The drive elements 50, 51, 55 may be part of a drive block in which the stationary mounting of the guide rods 52*a*, 52*b* can easily be accomplished. In this case the possibility exists of mounting the electric motor on the outside for better dissipation of the heat losses.

By making slits in the front side of the drive block, then the coupling pieces for the plug springs together bracket the two drive legs 51*a* to the plungers of the main head 5 and the storage head 4.

The entire displacement unit of the serial pump arrangement 1 which is equipped on the outside and with the pump chambers 5, 4 together with the corresponding pistons and piston guide sleeves also with an inlet module (rotary valve/low pressure gradient valve system) and with an outlet module (pressure sensor/venting valve) in this case need only be ranged onto the drive block as a closed structural group and the plungers subsequently coupled to the drive pistons by the plug springs.

Figure 4:
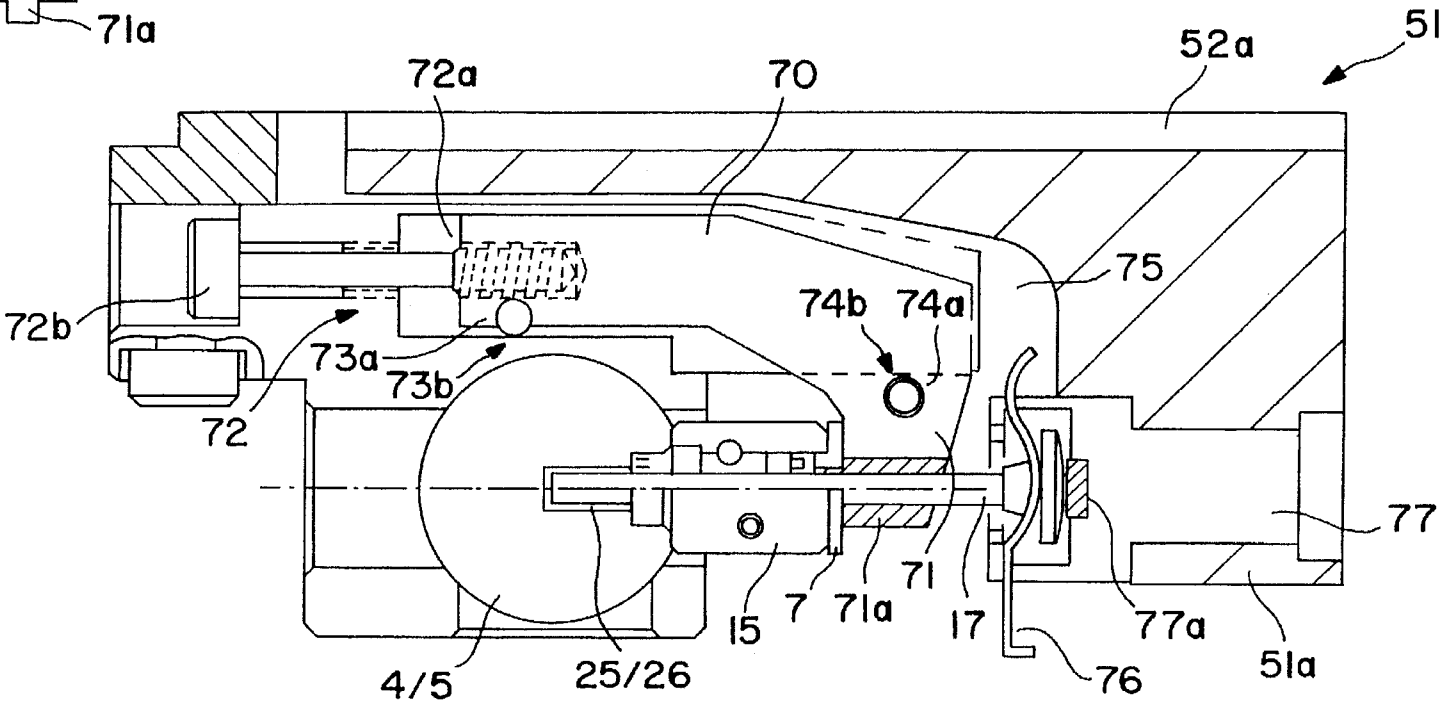
FIG. 4 and 4*a* showing holding hook 70, 71 providing the compression of the piston guide bushing 15, 16 with block disc elements 4,5 being arranged in stack construction ("sandwich"); whereby

FIG. 4 shows the clamping device 70 for the piston guide sleeves 15, 16 in which the plungers 17, 18 of the serial pump unit slide in combination with the main head 5 or the storage head 4. These sleeves permit a continuous or discontinuous back rinsing of the piston seals in the main head 5 and in the storage head 4 via connections in order to prevent the formation of salt crystals during the conveying of buffer solutions.

The clamping hook 70 presses through a shim ring 7 on the piston guide sleeve 15. This shim ring simultaneously serves as the support ring for the assigned secondary piston seal which assures the dynamic sealing of the rinsing chamber in the piston guide 15 to the outside.

The plunger 17 extends through the piston guide sleeve 15 flush with the piston seal into the displacement chamber of the main head 5 or the storage head 4 (liquid conveying function according to the serial pump principle). The axis of the stack is also to be understood as protruding above the plane of the paper.

Above the clamping hooks 70, 71 the Z drive piston 51 is shown schematically which is connected with the outer end of the plunger 17 according to the plug spring principle. The freely floating support thus achieved at the coupling site assures a guidance of the plunger free of side loads relative to the installed position of the piston seal.

Figure 4A:
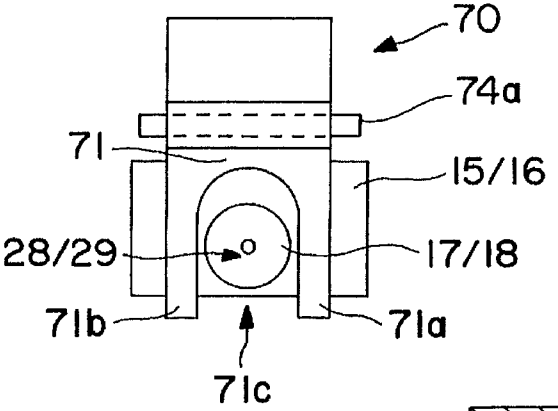

FIG. 4*a* shows the representation in FIG. 4 in from view, the plunger axes 28, 29 (along the plungers 17, 18) being understood here as protruding out of the plane of the paper.

The mounting hook 70, 71 displays an elongated body 70 which passes at one end into an overhanging fork fitting 71. The transition region may be chamfered or slightly shifted. The fork fitting 71—as FIG. 4*a* shows—with the prongs 71*a*, 71*b* forms a groove 71*c* for the contactless penetration of the plunger 17. With the fork fitting 71 as the counterbearing for the shim ring 7 the guide sleeve 15 is pressed on the function block 4 (here the conveyor head is shown). To press it on the screw 72*b* is tightened which catches in the clamping hooks 70, 71 via a thread 72*a* at the rear end of the body 70. The tightening causes the displacement of the clamping hooks 70, 71 parallel to the axis 28 of the piston guide sleeve.

To support the parallel moving clamping hook 70 two rest supports 73*a*, 73*b* or 74*a*, 74*b* are provided. They are arranged off-set with respect to each other both in the longitudinal and in the cross direction of the clamping hook. The bearing 74*a* is designed as a cross running pin which is pressed between the body 70 and the fork fitting 71 into the clamp hook in the transition zone. The pin ends protruding accordingly on both sides rest on the shoulders of a guide groove 75 for the clamp hook in the main body of the displacement system. The other bearing acts as a slip bearing on which a support bulge or bead 73*a* protrudes from the body 70 of the clamp hook and can slide on a counterbearing surface 73. The support point of the flat bearing 73*a* on the sliding surface 73*b* and the support regions of the pin ends 74*a* on the shoulders 74*b* of the receiving and guiding groove 75 are off-set with respect to each other transversely to the axis 28 of the plunger 17. Forces acting by hydraulic loading via the piston seal on the piston guide sleeve 15 can thus not lead to a twisting of the L-shaped clamping hooks 70, 71, since the two spatially shifted supports catch the torque which is created, the two bearings 73, 74 at this time permit an inflexible parallel displacement of the clamping hook with high accuracy which permits a finely adjustable pressing of the guide sleeve over the shim ring 7 at the exit of the displacement chamber boring in the function box 4,5.

Behind the clamping arrangement for the piston guide sleeve the stroke movement of the Z drive piston 51 takes place. This stroke movement, the longitudinal displacement of the clamping hooks 70, 71 and the stroke movement of the plunger 17, 18 all take place parallel to one another and transversely to the axis of the stack 27 of the functional components 4, 5, 6, 7.

Figure 5:
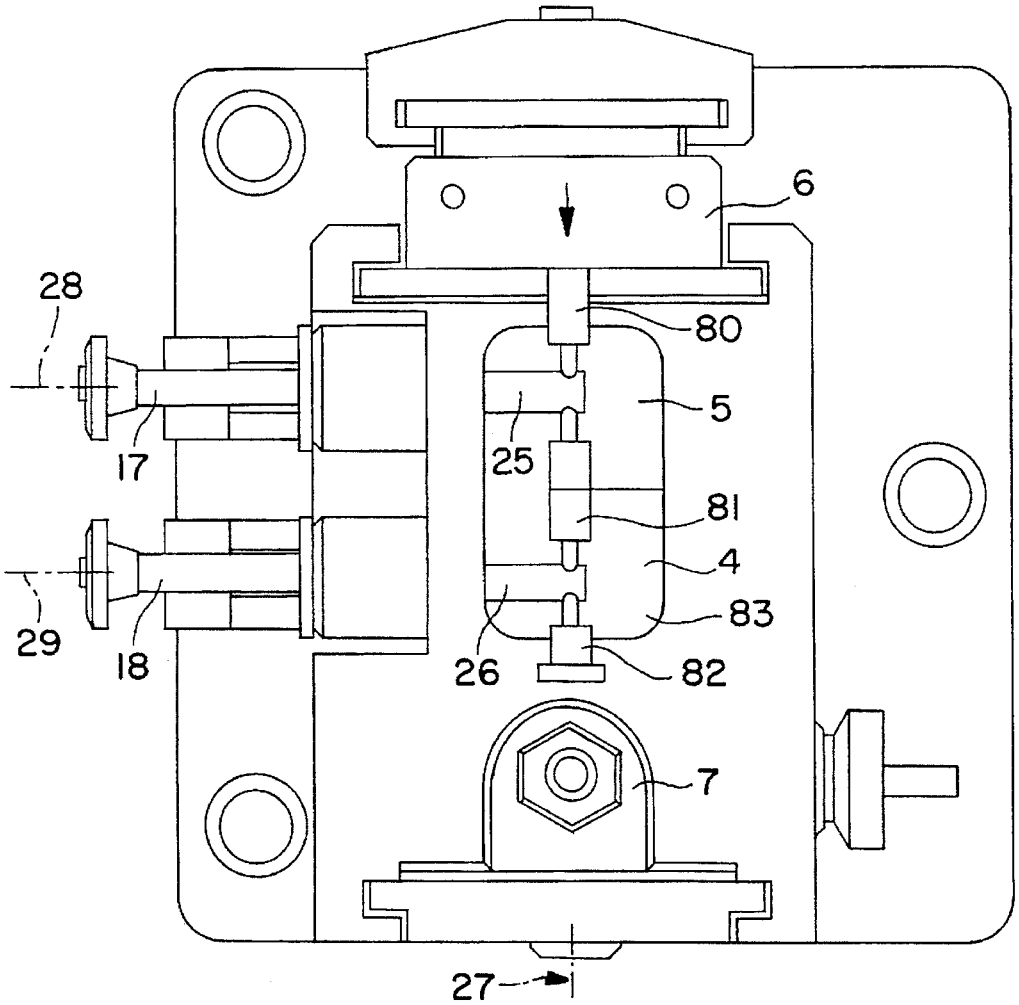
FIG. 5 showing the same cross-sectional view as FIG. 1 and 2, however, with modified check valve configuration.

FIG. 5 shows a partially cut-away view as do FIGS. 1 and 2, with schematic emphasis on the plunger 17, 18 and the essence of the sandwich-serial pump arrangement 6, 5, 4, 7 with block disk function carriers arranged in a stack immediately adjacent to one another.

Transversely to the stack axis 27 are the axes 29, 28 of the plunger and accordingly also of the displacement chambers 25, 26 in the main head and storage head. The functional units 6, 5 and 5, 4 are connected to one another in a liquid transferring manner by valve cartridges 80, 81 and the functional units 4, 7 by a dummy cartridge 83. Valve cartridges and dummy cartridges are shown schematically in the installed position relative to a milled out recess 83 in the housing body 99 for the sandwich stack with the components 4, 5, 6, 7.

The valve cartridges by themselves are closed subunits which may optionally be equipped with one or two ball valves 80*b*, 80*c*, 81*b*. A dummy cartridge 82 with a single through-boring permits the formation of a single connecting channel between two corresponding functional units. The various cartridges are suitable for coupling the functional units stacked on one another in a liquid-tight manner and of aligning them with one another. With half of their length they extend into the central receiving borings provided in the functional elements. In the case of the main head and the storage head these receiving borings open in turn via fine piercing borings into the displacement chamber borings.

The valve cartridge 80 shows the configuration of the double outfitting with a miniaturized ball valve—for more sensitive response of the ball even in the case of extremely low conveying rates; the valve cartridge 81 in turn shows the configuration for equipping with a ball valve of larger dimensions.

Figure 5A:
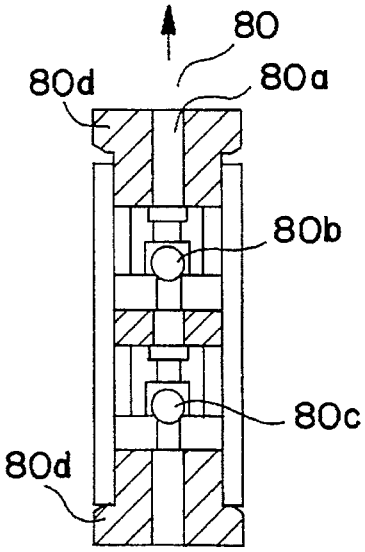
FIG. 5*a* and 5*b* showing check valve cartridge (80, 81) featuring one or two check valves.
Figure 5B:
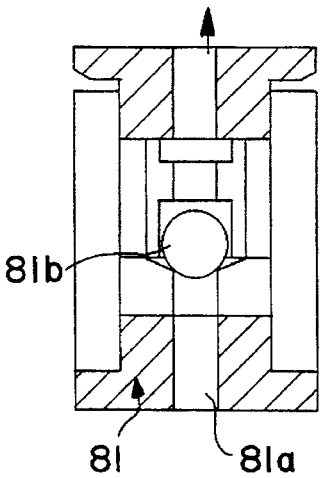

FIGS. 5*a* and 5*b* show a basic diagram of the valve cartridges.

The ball valves as the basic components preferably consist of a ruby ball and a sapphire/ceramic valve seat with a specially ground sealing edge. As shown in combination with special dimensionally adapted ball stop/ball guide elements and peripheral sealing ring they may consist of chemically resistant plastics in housing sleeves (e. g. of stainless steel or titanium) and can be completed as closed functional units.

Figure 5C:
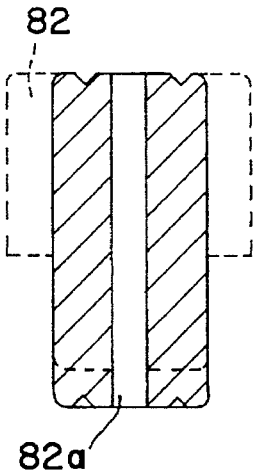
FIG. 5*c* shows in cross section a dummy valve cartridge with a central through-boring. These cartridges and also the additionally shown dummy cartridge are arranged between the functional discs 6,5 and 4 or 4 and 7 respectively according to FIG. 5. All cartridges provide alignment for the functional discs and, in the case of the check valves cartridges, flow control.

FIG. 5*c* shows in cross section a dummy valve cartridge 82 with a central through-boring 82*a*. This cartridge or connecting sleeve may form a coupling element between the storage head function unit 4 and the vent valve/pressure sensor function unit 7 between which no valve is required but rather a transition piece installed in the fitted seat.

Figure 6:
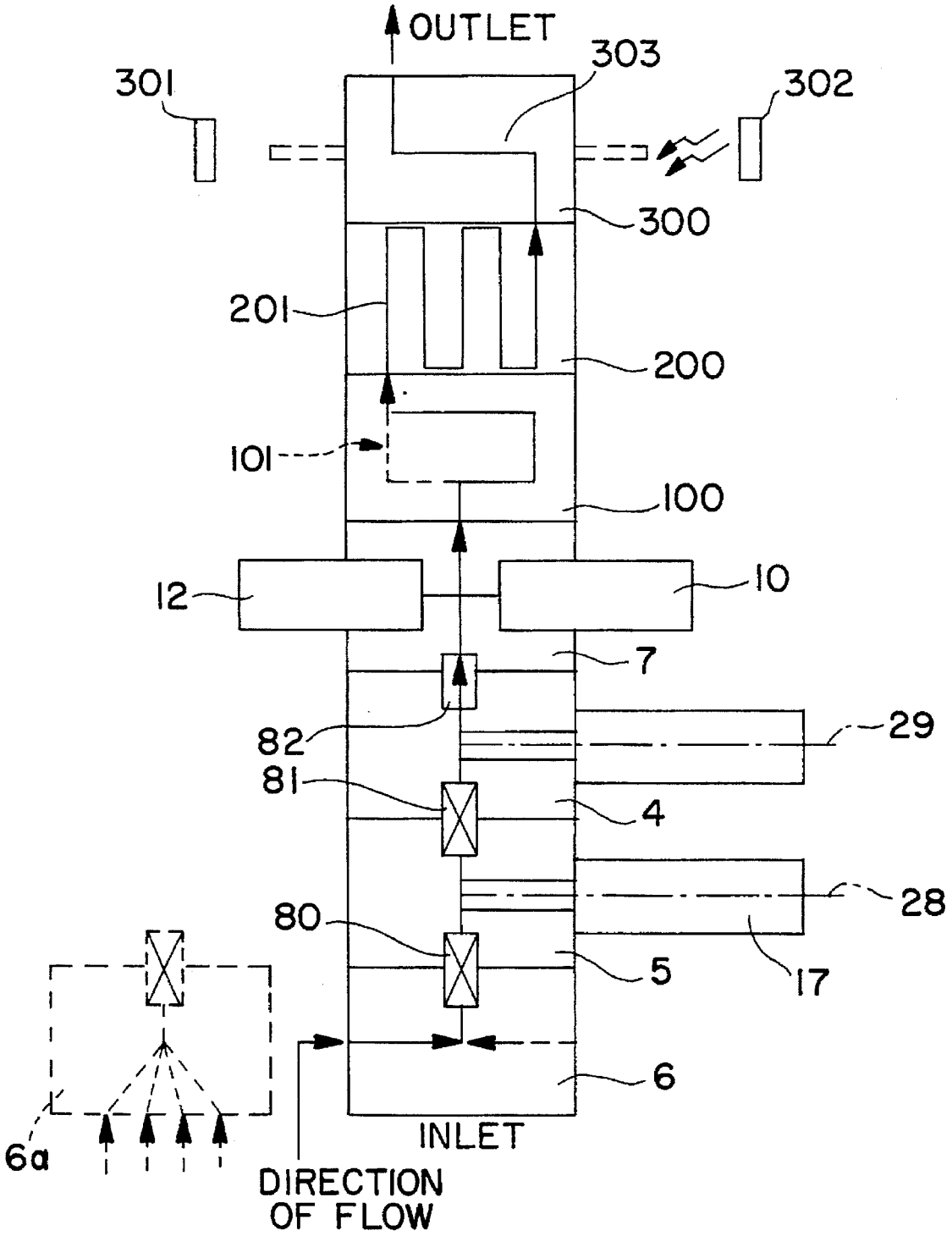
FIG. 6 shows a stack of functional units in which an inlet module 6, the serially operating displacement chambers 4, 5, an outlet module with pressure sensor and air venting valve 7, a sample charging valve 100, a separation column 200 with meander-like packing and a detector measuring cell 300 are combined to form an entire stack and in this way form the complete wet part of a miniaturized HPLC analysis system.

FIG. 6 shows in principle an HPLC analysis system which is designed completely in the stacked mode. The above-mentioned functional units 4 through 7 are represented only schematically, where the input module, for example, may be the low pressure gradient former 6*a* shown by the dotted line. To the gradient former the first valve cartridge 80 (inlet valve) is connected which passes into the main head 5 which operates with the plunger 17 (whose central axis 28 is shown). This is followed in the downstream direction by another valve cartridge 81 (outlet valve) which connects the main head 5 to the storage head 4. In the storage head the plunger 18 is operating (whose central axis 29 is shown). Through the dummy cartridge 82 the conveyed stream passes from the displacement system into the venting valve/pressure sensor module 7 (functions 10 and 12) and from there directly into the sample charging valve function unit 100 with a channel 101 for sluicing the sample to be analyzed into the (eluent) conveyed stream. This functional unit may then also be combined with an automatic sample charging system.

Directly coupled to this is the separating column in a special configuration which fits with the concept of the overall structure according to the sandwich principle. The separation column is either constructed as a functional unit of short segments tied into a block which are alternately connected with one another in the narrowest space on the end sides or contain packings of a meandering or spiral structure.

The (eluent) conveyed stream passes from the separation column functional unit finally directly into the measurement cell which is uncoupled from the electronic detector part processing the measurement signal for the purpose of substance detection. The basic representation of an optical measurement cell is shown. The measurement cell may also be inserted in a similar manner into an electrochemical detector.

In the manner described an instrument is designed which has all the functional units of the wet part of a specific HPLC analysis system in a compact arrangement with the lowest dead volume partly reversing the separation result. At the same time the various functional units can mechanically be held together in a simple way.

FIG. 7 shows in an exploded view an example of implementation of the concept of a displacement unit for a serial high-pressure pump in the stacked construction mode illustrating the assembly of the components.

The foundation is the four functional units 6, 5, 4 and 7 which are installed in a common receiving boring in a protruding part of the housing body 99. Due to the fact that the receiving boring is opened in several places by slots and borings on the front and to the sides, the functional units used are visually accessible and their installation and removal facilitated.

As the supporting base for a mutually liquid-tight holder for the stacked functional units at the upper and lower edge of the receiving boring one finds insertion grooves for a cover plate 98 or for a flange ring 6*a* on the inlet module 6. Both this module and the storage head unit are connected each via a valve cartridge 81 with the intermediate main head function unit 5 with respect to the liquid flow path and in order to produce an exact mechanical alignment with one another and simultaneously control the conveyed stream in the rhythm of the stroke movement of the plunger in the main head (inlet/outlet valves).

The receiving borings for the valve cartridges are designed as flange-collar borings which open into farther-going narrow lumen piercing borings, thus in the displacement chamber boring 25, 26 in the main head and in the storage head.

Guide sleeves 15, 16 are pressed against the flattened areas on the function units 4 and 5 in alignment with the piston seals contained in them (high pressure) with a force which compensates for the hydraulic load on the piston seals without yielding under maximal conveying pressure. This is accomplished by means of the clamping hook 70, 71 which, on the one hand, rests with a pin 74*a* extending on both sides on the shoulder edge of the receiving groove in the region of the attachment flange of the housing body, and on the other, with a support bulge on the opposite end is pressed against the base of the receiving groove when the clamping screw, shown in the loose state, is tightened, which results in longitudinal mobility of the clamping hook exactly parallel to the axis of the drive piston and the plunger.

The plungers 18, 19 both in the installed view (bottom: main head 5) and also in the detailed view are shown enclosed by forks 71*a*, 71*b* of the supporting fixture on the clamping hooks 70, 71. Functionally viewed the piston executes its strokes without contacting this fork fitting.

Behind the clamping hook arrangement 70, 71 the Z-shaped drive piston 51 for the main head is shown, relative to the storage head 4 with the end piece for engaging the plug spring which assures a connection between the drive piston 51 and the plunger 18 that is axially rigid but radially permits a certain deflection.

Also shown in detail is the bifunctional outlet module 7 with pressure sensor 10 and air venting spindle valve 12 as well as the inlet module based on a two-way/check valve.

From the exploded view one sees that conveying proceeds from bottom to top in the displacement system while all other movement and activation directions, that of the stroke movement of the drive piston and the plunger and the pulling direction of the clamping hooks 70, 71 are transverse to the sleeves of the piston guide but among each other are exactly parallel with one another.

From the figure there further emerges the especially advisable simplicity of the design of the sandwich construction in terms of function and operation, relative to the displacement system of a serial pump arrangement. This is also true with respect to the proposed design of the corresponding drive unit and the clamping mechanism for the mutually liquid-fight pairing of the individual functional units and with respect to the aspect of a miniaturized construction.

The high pressure pump arrangement in FIG. 1 permits conveying in the pressure range up to 400 bar customarily used in HPLC analytic techniques with high reproducibility even in the microliter conveying range down to 10 μl/min. The arrangement is also basically suitable for any use in which the conveying pressure is above atmospheric pressure.

I claim:

1. Serial-type sub-miniaturized dual piston pump set-up for constant and continuous mass flow, comprising:

(a) two pumping units arranged serially to each other with respect to a direction of flow, each pumping unit having a liquid displacement piston;

(b) two check valves, at a suction side and a delivery side, respectively; and, (c) a series of block/disk-shaped constructional elements arranged adjacent each other at respective control surfaces to form a stack/sandwich-type build-up, with two of the constructional elements having each a liquid displacement chamber, perpendicularly orientated to an axis of the stack/sandwich-type build-up, receiving respective ones of the pistons, and being fitted with liquid ducts for feeding and discharge in a parallel direction of said axis.

2. Pressure pump set-up according to claim 1, in which: one of the check valves is incorporated in each of the two pumping units.

3. Pressure pump set-up according to claim 1, in which: the check valves are configured as cartridges, each directly inserted one of in the block/disk-shaped constructional elements and in a special case fitted with a liquid displacement chamber having a ball guide/ball stopper bore profile directly machined therein.

4. Pressure pump set-up according to the claim 1 in which: in the stack/sandwich-type build-up the two block/disk-shaped constructional elements, which feature the liquid displacement chambers, are locked between two additional stack/sandwich layer elements which form a complete liquid displacement assembly, two additional elements define an inlet and an outlet; wherein:

(a) the inlet element is arranged to perform a manifold function by a given means chosen from one of a switching and shutting valve, as one choice, and several slider valves for low pressure side gradient forming as another; and, (b) the outlet element is arranged to perform a pressure monitoring (10) and bleeder valve function (12).

5. Pressure pump set-up according to claim 4, in which: the block/disk-shaped constructional element at the inlet element features a feeding duct parallel to the axis of the stack/sandwich-type build-up, which discharges into a liquid channel of a rotary valve (8,9) at one end of the stack/sandwich-type build-up, and has switching positions, which, depending on the switching position, establishes or inhibits a liquid connection between an inlet bore and one of a separate elbow-shaped feeding flow ducts, which are circumferentially distributed within the inlet element.

6. Pressure pump set-up according to claim 4, in which:

(a) the block/disk-shaped constructional element at the outlet features an outlet bore parallel to the axis of the stack/sandwich-type build-up, which leads into an adjacent pressure chamber in front of a pressure transducer, which is positioned at a top-side of the stack/sandwich build-up;

(b) whereby the outlet bore features a lateral bifurcation, which is paired with a closing spindle of a bleeder valve; and, (c) a delivery flow is led away at the pressure side via an opposite elbow-shaped duct.

7. Pumping set-up according to claim 1, in which:

(a) between two block/disk-shaped constructional elements a replaceable check valve cartridge is inserted, which includes check valves;

(b) one part of the check valve cartridge is fitted in each of the adjacent block/disk-shaped constructional elements in such a way that said cartridges provide liquid connections and mutual alignment of both adjacent functional disks.

8. Pressure pump set-up according to claim 1 in which: all bores being parallel to the axis of the stack/sandwich-type build-up in all block or/disk-shaped constructional elements are mutually aligned.

9. Pressure pump set-up according to claim 1, in which all constructional elements pertinent to the stack/sandwich-type build-up are arranged between the arms of a yoke, or in the receiving bore of a housing block and are, preferably by means of flange seals, pressed to each other by a compression screw to achieve liquid-tight sealing.

10. Pressure pump set-up according to claim 1, in which each of the constructional elements, fitted with the liquid displacement chambers, features a flat section at a mantle surface, at which a piston guide bushing is to be placed.

11. Pressure pump set-up according to claim 10, in which: the displacement piston guide features two piston guide rings made from a ceramic material, with said rings fitted apart into a bushing of stainless steel or titanium, forming a rinsing chamber and being at the same time externally sealed.

12. Pressure pump set-up according to claim 1, in which:

(a) the displacement pistons have rounded ends and said pistons are via said ends fixed to a holding piece of a piston-driven Z-shaped drive linkage by means of an insertion spring which is dismountable, transversely to an axis of the pistons;

(b) whereby the insertion spring allows and is able to compensate for a small rotation of the drive piston relative the displacement piston.

13. Pressure pump set-up according to claim 1, in which the displacement pistons are oscillating in the pumping units.

14. An assembly method for a serial-type high pressure pump set-up of chemically inert material comprising the steps of:

(a) supplying, in a stack/sandwich build-up space, a variety of functional units arranged to perform a variety of functions chosen from directing a feeding flow, forming a gradient at a low pressure side, deviating a displacement flow and measuring a working pressure on a discharge side, displacing liquid by means of a main piston, and, storing and displacing liquid displaced by the main piston by means of a storage piston, wherein the storage piston delivers stored liquid when the main piston retracts;

(b) combining the supplied variety of functional units with each other, directly sealed to each other by virtue of congruent shape within the stack/sandwich-type build-up space; and, (c) radially fixing and axially pre-loading the functional units in the stack/sandwich build-up space by means of a clamping device.

15. Method according to claim 14, whereby the functional units are mainly disk-shaped.

16. Method according to claim 14, in which an outlet valve of one of the pumping units is integrated into a neighboring pumping unit.

17. Method according to claim 14, in which a ball stopper and a multi-bore ball guide profile are directly machined into a functional unit which provides liquid displacement, with additionally at least one check valve ball) together with a seat inserted therein.

18. Method according to claim 17, in which the check valve seat is fixed and peripherally sealed by means of a flanged sealing ring.

19. Method according to claim 18, in which the stack/sandwich-type build-up formed by the functional units, is radially aligned by means of the flange of the sealing ring.

20. Serial-type sub-miniaturized high pressure pump set-up, comprising:

(a) at least one pumping unit arranged with which only one displacement chamber is associated and one valve is arranged directly at an inlet to the displacement chamber as extending perpendicular to a longitudinal axis of said chamber; and, (b) a series of block/disk-shaped constructional elements arranged adjacent each other at respective control surfaces to form a stack/sandwich-type build-up, with one of the constructional elements including the liquid displacement chamber, perpendicularly orientated to an axis of the stack/sandwich-type build-up, receiving the piston, and being fitted with liquid ducts for feeding and discharging in a parallel direction of the axis.

21. A compact drive unit and a serial-type subminiaturized dual piston high pressure pump set-up, in combination, in which the pump comprises:

(a) two pumping units arranged serially to each other with respect to a direction of flow, each pumping unit having a liquid displacement piston;

(b) two check valves at a suction side and a delivery side, respectively; and, (c) a series of block/disk-shaped constructional elements arranged adjacent each other at respective control surfaces to form a stack/sandwich-type build-up, with each of two of the constructional elements having a liquid displacement chamber, perpendicularly orientated to an axis of the stack/sandwich-type build-up, receiving respective ones of the pistons, and being fitted with liquid ducts for feeding and discharging in a parallel direction of said axis; and, the drive unit comprising a Z-shaped drive linkage, which Z-shaped drive linkage includes:

(a) a rotating cam that is arranged in mechanical contact with a first side-arm of the Z-shaped drive linkage by means of a roller, whereby the cam is in mechanical contact with at least one of the displacement pistons;

(b) the first arm being slidably guided by means of at least one bearing on two fixed guiding rods;

(c) the first arm having a rigidly mechanical connection with a second arm, with the second arm being essentially in parallel alignment with the first arm, the second arm having a free end in contact with a rounded external end of said at least one displacement piston.

22. Drive unit according to claim 21, in which:

(a) the first arm and the second arm have a rigidly mechanical connection by means of an intermediary arm;

(b) the intermediary arm is mainly perpendicularly orientated to the first and the second arm, forming together with them the Z-shape of the Z-shaped drive linkage.

23. Drive unit according to claim 22, in which:

(a) the cam is indirectly in contact with the first arm via a rotating roller;

(b) the first arm is pre-loaded by means of an axial spring in such way that in spite of the reciprocating motion induced by the cam onto the first arm and the Z-shaped drive linkage respectively, the mechanical contact between roller and the cam is never lost, thus generating a filling stroke.

24. Drive unit according to claim 23, in which the axial spring and the cam are acting on the first arm in opposite directions.

25. Drive unit according to claim 21 in which: the cam is linked via a gear to a controllable electric motor, especially to a digitally controlled DC motor.

26. Drive unit according to claim 21 in which:

the two fixed guiding rods are spaced apart in parallel with the first arm and disposed on either side of the contact point between the cam and the first arm and its roller respectively, thus allowing a parallel sliding of the first arm and the Z-shaped linkage respectively.

27. Drive unit according to claim 22 in which:

one of the guiding rods travels through the intermediary arm embodying the bridge section of the Z-shaped drive linkage.

28. Drive unit according to claim 27 in which two axial bearings are working in conjunction with and are slidable respectively on one guiding rod, which travels through the intermediary arm.

29. Drive unit according to claim 21, in which:

three bearings are provided at the drive linkage, which drive linkage is, with said axial bearings, slidable on the guiding rods in parallel direction thereby suppressing canting and rotating motions.

30. Pressure pump set-up according to claim 1, further comprising a restraining device for the piston guide bushings in the serial-type pump set-up, which restraining device includes:

(a) an elongated trunk, at which one end a holding screw is gripping in;

(b) and, as arranged transversely to the elongated trunk, a protruding fork section, which is located at the other end of the trunk;

(c) wherein two supporting buttresses are provided at the elongated trunk, spaced apart from each other.

31. Restraining device according to claim 30, in which the arms of the fork section, which protrude from the elongated trunk, form a groove, through which the piston of the storage and pumping unit run freely.

32. Restraining device according to claim 31, in which the fork arms and the trunk form an L-shaped holding hook.

33. Restraining device according to claim 30, in which:

the actual holding device is a screw at a main body of the serial pumping set-up, gripping into a threaded bore at the end of the trunk.

34. Restraining device according to one of the claim 30, in which:

the two supporting buttresses, in reference to both a longitudinal and transversal axis of the trunk, are offset in order to deploy leverage.

35. Restraining device according to claim 30, in which the supports are buttresses, being effective in opposite directions.

36. Restraining device according to claim 30, in which:

(a) one of the supports comprises a cross-pin located in the transition area between the trunk and fork, whereby the ends of the cross-pin which are protruding from the trunk, rest upon and are counter-supported at a flange and in a guiding slot of the main body; and (b) another of the supports forms a protruding surface, which stands off from the trunk in a direction of the displacement piston axis.

37. Compact HPLC analysis system comprising:

a serial pumping stack/sandwich-type build-up directly bordering a substance analysis stack/sandwich-type build-up, in which:

(a) the pumping build-up comprises a series of block/disk-shaped functional sub-units, which are aligned and directly adjacent to each other, whereby a delivery sub-unit is followed by a storage sub-unit, which is followed by a bleeder valve/pressure sensor sub-unit;

(b) the bleeder valve/pressure sensor sub-unit is followed by a sample injection sub-unit;

(c) a sample injection sub-unit and a multi-channel HPLC separation column attached to the sample injection sub-unit, with the column having a coil shape; and, (d) the separation column sub-unit is followed by a detector cell functional sub-unit.

38. Analysis system according to claim 37, in which:

the sample injection functional sub-unit, the multi-channel HPLC separation column functional sub-unit and the detector cell sub-unit are joined together to a compact analysis stack/sandwich set-up without any intermediary tube lines.

39. Analysis system according to claim 37, in which in the pumping stack/sandwich-type build-up a low pressure side gradient forming functional sub-unit precedes an eluent delivery functional unit.

40. Compact analysis system, in combination with a serial-type subminiaturized dual piston pump set-up for constant and continuous mass flow, wherein the pump comprises:

(a) two pumping units arranged serially to each other with respect to a direction of flow, each pumping unit having a liquid displacement piston;

(b) two check valves at a suction side and a delivery side, respectively;

(c) a series of block/disk-shaped constructional elements arranged adjacent each other at respective control surfaces to form a stack/sandwich-type build-up, with each of two of the constructional elements having a liquid displacement chamber, perpendicularly orientated to an axis of the stack/sandwich-type build-up, receiving respective ones of the pistons, and being fitted with liquid ducts for feeding and discharging in a parallel direction of said axis; and, the analysis system comprises a delivery functional sub-unit, a storage functional sub-unit and a pressure sensor/bleeder valve functional sub-unit.

* * * * *